US008832946B2

(12) United States Patent
Howdeshell, II et al.

(10) Patent No.: US 8,832,946 B2
(45) Date of Patent: Sep. 16, 2014

(54) CUTTING BLADES AND ASSEMBLIES

(75) Inventors: Dwight E. Howdeshell, II, Arnold, MO (US); Frank J. Weber, St. Louis, MO (US); Rex Poff, Burnsville, MN (US); Dennis C. Schuette, Plymouth, MN (US); Ray Johnson, New Richmond, WI (US)

(73) Assignee: Nestec S A, Vevey (CH)

( * ) Notice: Subject to any disclaimer, the term of this patent is extended or adjusted under 35 U.S.C. 154(b) by 704 days.

(21) Appl. No.: 12/735,669

(22) PCT Filed: Feb. 5, 2009

(86) PCT No.: PCT/US2009/000742

§ 371 (c)(1),
(2), (4) Date: Oct. 27, 2010

(87) PCT Pub. No.: WO2009/009629

PCT Pub. Date: Aug. 13, 2009

(65) Prior Publication Data

US 2011/0036058 A1 Feb. 17, 2011

Related U.S. Application Data

(60) Provisional application No. 61/063,920, filed on Feb. 7, 2008, provisional application No. 61/063,919, filed on Feb. 7, 2008.

(51) Int. Cl.

| | |
|---|---|
| ***B26F 3/00*** | (2006.01) |
| ***B26F 3/02*** | (2006.01) |
| ***B65H 35/00*** | (2006.01) |
| *B26D 1/00* | (2006.01) |
| *B65B 51/06* | (2006.01) |

(52) U.S. Cl.

CPC ..... *B65H 35/008* (2013.01); *B26D 2001/006* (2013.01); *B65B 51/062* (2013.01); *B26D 1/0006* (2013.01)

USPC ... 30/346.55; 53/136.5; 53/284.7; 30/346.56; 30/355; 225/2; 225/91

(58) Field of Classification Search

CPC ..... B26F 3/02; B26B 19/3846; B26D 1/085; B26D 1/626

USPC ..... 53/416, 481, 482, 136.5, 138.1, 139.1, 53/284.7; 30/346.55, 346.56, 355, 357; 225/2, 91; D8/19, 20, 95–104; D15/133, 134, 138, 139

See application file for complete search history.

(56) References Cited

U.S. PATENT DOCUMENTS

| | | | | | |
|---|---|---|---|---|---|
| 269,728 | A | * | 12/1882 | Simonds | 83/849 |
| 1,986,043 | A | * | 1/1935 | Carter | 53/482 |
| 2,023,682 | A | * | 12/1935 | Higginbottom | 53/415 |

(Continued)

*Primary Examiner* — Stephen F. Gerrity
*Assistant Examiner* — Eyamindae Jallow
(74) *Attorney, Agent, or Firm* — Julie M. Lappin; Aaron J. Morrow; Robert M. Barrett

(57) ABSTRACT

The invention comprises cutting blades useful for cutting tape in packaging processes and cutting assemblies or bag sealing assemblies using the blades. Generally, the blades comprise a support and a plurality of teeth attached to the support wherein a first set of a plurality of the teeth defining a flat tip are positioned on the support between a second set of a plurality of the teeth defining a sharp tip and a third set of a plurality of the teeth defining a sharp tip.

20 Claims, 2 Drawing Sheets

(56) References Cited

U.S. PATENT DOCUMENTS

| | | | | | |
|---|---|---|---|---|---|
| 2,089,483 | A * | 8/1937 | Jaenicke | 229/117.34 |
| 2,571,103 | A * | 10/1951 | Belcher et al. | 53/136.5 |
| 2,586,931 | A * | 2/1952 | Gammon | 24/30.5 P |
| 2,842,202 | A * | 7/1958 | Boyd | 83/678 |
| 2,938,267 | A * | 5/1960 | Tupper | 30/142 |
| 4,426,035 | A * | 1/1984 | Dieckow | 206/526 |
| 5,095,790 | A * | 3/1992 | Pattillo | 83/13 |
| 5,706,583 | A * | 1/1998 | Gengenbach | 30/166.3 |
| 5,954,916 | A * | 9/1999 | Orlandi | 156/386 |
| 6,119,439 | A * | 9/2000 | Stevie | 53/455 |
| 6,173,876 | B1 * | 1/2001 | Sano et al. | 225/39 |
| 6,405,913 | B1 * | 6/2002 | Passamoni | 225/43 |
| 6,524,022 | B2 * | 2/2003 | Minowa et al. | 400/621 |
| 6,851,592 | B1 * | 2/2005 | Owen et al. | 225/1 |
| 6,973,855 | B2 * | 12/2005 | Yanosaka et al. | 76/101.1 |
| 7,198,086 | B2 * | 4/2007 | Dusich | 156/527 |
| 8,479,400 | B2 * | 7/2013 | Fukutani et al. | 30/195 |
| 2003/0141337 | A1 * | 7/2003 | Yu Chen | 225/89 |
| 2004/0016128 | A1 * | 1/2004 | Yanosaka et al. | 30/225 |

* cited by examiner

FIG. 1
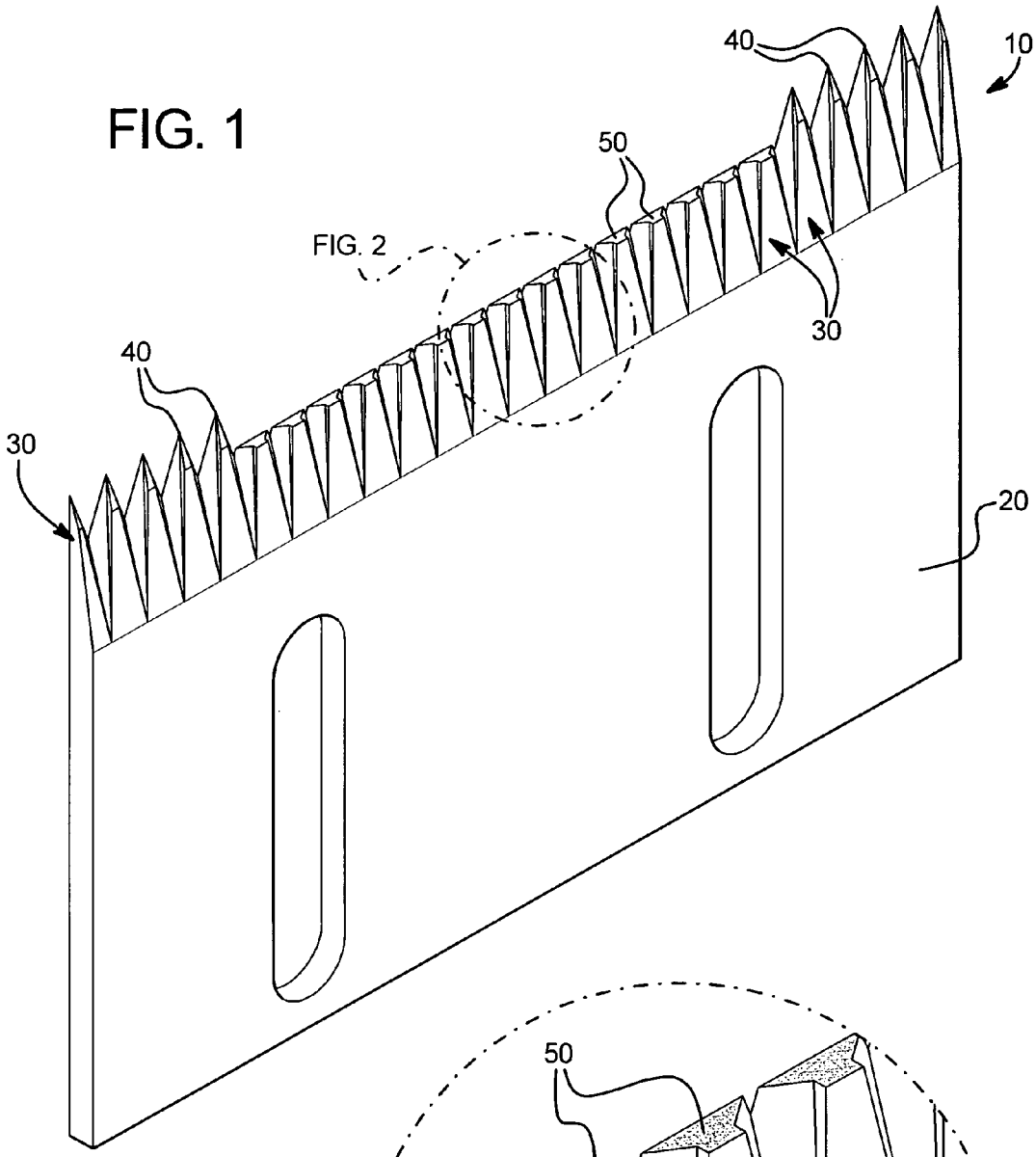
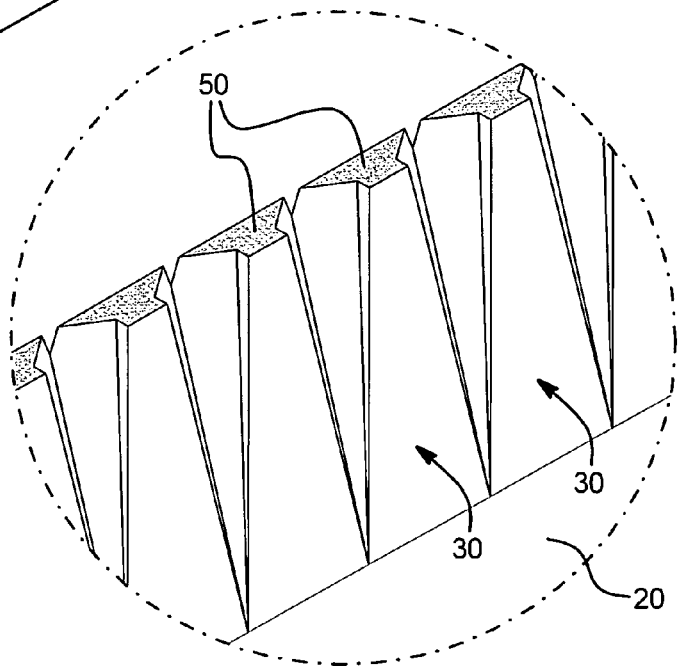
FIG. 2

CUTTING BLADES AND ASSEMBLIES

CROSS REFERENCE TO RELATED APPLICATIONS

This application is a national stage application under 35 U.S.C. §371 of PCT/US2009/00742 filed Feb. 5, 2009, which claims priority to U.S. Provisional Application Ser. No. 61/063,919 filed Feb. 7, 2008 and U.S. Provisional Application Ser. No. 61/063,920 filed Feb. 7, 2008, the disclosures of which are incorporated herein by this reference

BACKGROUND OF THE INVENTION

1. Field of the Invention

The present invention relates generally cutting devices and particularly to cutting blades and assemblies useful for cutting various materials such as tape used in packaging operations.

2. Description of Related Art

Packaging machines or assemblies for sealing filled packages such as bags are well known. Many of these machines fill a package through an open end and then seal the package with tape. To create an effective seal that will not lose its grip, the tape must be properly applied to the package. Generally, this involves cutting the tape to the desired length and applying it to the proper place on the package or applying the tape to the package and cutting it at a desired location. This is typically accomplished using a cutting knife or blade that shears the tape at the proper location as the machine applies the tape to the package.

After the tape is applied, it is important that the tape remain stuck to the package until it is intentionally removed and that the tape not tear and disrupt the integrity of the seal until the package is intentionally opened. It is particularly important that the tape not tear or otherwise compromise the integrity of the seal while the package being handled, e.g., during manufacture, during transport to market, or by the consumer.

There are a variety of cutting knives or blades that can be used to cut the tape used to seal or close the packages. Generally, known or standard knives used to cut the tape leave a serrated edge at the cut, typically at both ends of the tape that is cut using the knife. In some instances, the serrated tape edge contributes to a premature tearing (e.g., propagated tear) of the tape. This disrupts the integrity of the seal and leaves the package seal formed by the tape prone to rupture or breaking. There is, therefore, a need for new devices and methods for using tape to seal packages such that the tape that will not tear prematurely and lose the integrity of the tape seal.

SUMMARY OF THE INVENTION

The present invention provides cutting blades suitable for cutting various materials such as tape used in packaging and cutting assemblies or bag sealing assemblies comprising the blades. In a general embodiment, the present invention provides a blade comprising a support and a plurality of teeth attached to the support. One or more of the plurality of teeth defines a sharp tip and one or more of the plurality of teeth defines a flat tip.

In an embodiment, a first set of a plurality of the teeth defining a flat tip are positioned on the support between a second set of a plurality of the teeth defining a sharp tip and a third set of a plurality of the teeth defining a sharp tip.

In an embodiment, the first set comprises 15 teeth defining a flat tip.

In an embodiment, the second set and third set each comprises 4½ teeth defining a sharp tip.

In an embodiment, the second set of teeth and the third set of teeth comprise a combined length that ranges from about 15% to about 40% of the length of the support.

In an embodiment, the second set of teeth and the third set of teeth comprise a combined length that is about 20% of the length of the support.

In an embodiment, a difference in height between the first set of teeth and the second set of teeth ranges from about 5% to about 25% of a height of the blade, preferably about 23%, most preferably about 22.8%. In an embodiment, a difference in height between the first set of teeth and the second set of teeth is about 7%, 8%, or 9% of a height of the blade, preferably about 7.4%. In another embodiment, the height of the first set of teeth and the second set of teeth is about 25% of a height of the blade, preferably about 22.8%.

In an embodiment, the flat tip of the teeth defines a rough surface.

In an embodiment, the blade comprises a length of about 2.5 inches. In another embodiment, the blade comprises a height of about 1.6 inches.

In an embodiment, the blade comprises a thickness of about 0.065 inches.

In an embodiment, the blade comprises a single unitary piece.

In an embodiment, the support defines at least one aperture.

In an embodiment, the blade comprise a material such as a metal, a rigid plastic, or combinations thereof.

In another embodiment, the present invention provides a blade comprising a support, a first set of teeth comprising a flat tip attached to the support, a second set of at least four teeth comprising a sharp tip attached to the support, and a third set of at least four teeth comprising a sharp tip attached to the support. The first set of teeth is positioned between the second set teeth and the third set of teeth.

In an alternative embodiment, the present invention provides an assembly comprising a taping applicator comprising a blade holder and a blade attached to the blade holder of the taping applicator. The blade comprises a support and a plurality of teeth attached to the support. One or more of the plurality of teeth defines a sharp tip, and one or more of the plurality of teeth defines a flat tip. Taping applicators are well known to skilled artisans. Typical applicators contain a spool of tape, a mechanism for feeding the tape through the applicator, and a blade holder for supporting a blade used to cut the tape.

In yet another embodiment, the present invention provides an assembly comprising a tape, fold, and tuck (TFT) machine comprising a blade holder and a blade attached to the blade holder of the TFT machine. The blade comprises a support and a plurality of teeth attached to the support. One or more of the plurality of teeth defines a sharp tip, and one or more of the plurality of teeth defines a flat tip. TFT machines are known in the art. A typical TFT machine trims, folds, and tapes woven polypropylene bagging material to provide a sturdy, durable, easy-open seal. The TFT machine provides a double fold closure, typically having a fold depth of about 1.25 inches secured with 2 inch wide case sealing. The sealing method provides a closure designed to prevent leakage during shipping and storage. Some TFT machines have a programmable logic controller and human-machine-interface touch screen. Typically, the TFT machine is compatible with automatic feeding equipment and is easily integrated into most high speed automatic bagging lines.

In still another embodiment, the present invention provides a method for cutting a material. The method comprises providing a blade comprising a support and a plurality of teeth attached to the support, wherein at least one of the plurality of teeth defines a sharp tip and at least one of the plurality of teeth defines a flat tip. The method further comprises cutting the material with the blade.

In an embodiment, the blade is incorporated as part of a taping applicator.

In an embodiment, the blade is incorporated as part of a TFT bag sealing machine, including a TFT machine housing a taping applicator of the present invention.

In one embodiment, the material comprises a tape, a label or combinations thereof. In another embodiment, the material comprises a polypropylene tape.

In an alternative embodiment, the present invention provides a method for sealing a container such as a bag. The method comprises providing a blade comprising a support and a plurality of teeth attached to the support. At least one of the plurality of teeth defines a sharp tip and at least one of the plurality of teeth defines a flat tip. The blade is incorporated into a blade holder of a bag sealing machine. A bag is placed in the bag sealing machine. A tape is attached to a portion of the bag to seal off the bag. Finally, the tape is cut with the blade. In one embodiment, the bag machine is a TFT bag sealing machine. In another embodiment, the blade is in a taping applicator in a bag sealing machine, particularly a TFT bag sealing machine.

An advantage of the present invention is to provide an improved cutting blade.

Another advantage of the present invention is to provide an improved cutting assembly.

Yet another advantage of the present invention is to provide an improved method of cutting a material.

Still, another advantage of the present invention is to provide an improved bag sealing assembly or machine.

Moreover, an advantage of the present invention is to provide a tape cutting assembly.

Additional features and advantages are described herein, and will be apparent from, the following Detailed Description and the figures.

BRIEF DESCRIPTION OF THE FIGURES

FIG. 1 illustrates a front perspective view the blade in an embodiment of the present invention.

FIG. 2 illustrates an enlarged view of a portion of the blade of FIG. 1.

DETAILED DESCRIPTION OF THE INVENTION

Figure 3:
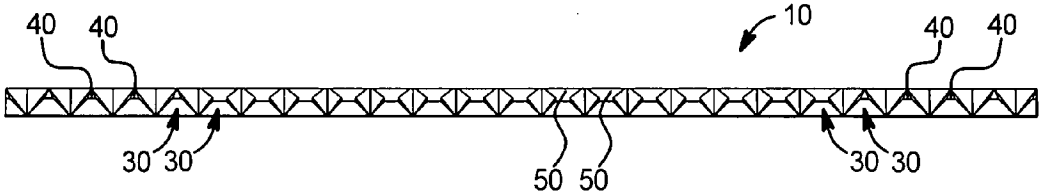
FIG. 3 illustrates a top view of the blade in an embodiment of the present invention.

In one aspect, the present invention provides cutting blades suitable for cutting various materials and cutting assemblies or bag sealing assemblies comprising the blades. The cutting blades can be used to cut many types of material, e.g., various types of tape used to seal bags or packages. The bags or packages can contain, for example, human food or pet food. The cutting blades can also be used in any suitable type of cutting assemblies or bag sealing assemblies.

Typically, cutting assemblies or bag sealing assemblies can be used in the manufacturing of sealed packages. For example, an open package is filled with a product and then a portion of the package near the opening is folded over. The bag sealing assembly can apply a tape to the folded portion of the package to prevent the folded portion from unfolding. If the tape is part of a roll, an excess portion of the tape is cut using a cutting blade incorporated as part of the bag sealing assembly. Accordingly, the tape can be cut to the exact size to properly seal the package.

Surprisingly, the blades of the present invention cut or break the tape used to seal a package without leaving any jagged edges or other deformations on the tape that could cause a premature tear propagation or other tape sealing failure. If the tape tears to easily, the package may open prematurely leading to undesirable results, e.g., spilling its contents. The tape can be a polypropylene tape that typically is used to seal off and enclose packages or containers. There is something in the design of the blade that permits it to cut or break the tape in a manner that prevents such premature tearing. Previous blade designs, as shown herein, cut or break the tape but leave the tape vulnerable to premature tearing, particularly propagation tears.

In an embodiment illustrated in FIGS. 1-4, the present invention provides a blade 10 comprising a support 20 and a plurality of teeth 30 attached to the support. One or more of the plurality of teeth 30 defines a sharp tip 40, and one or more of the plurality of teeth 30 defines a flat tip 50. As shown in FIG. 1, a first set of a plurality of the teeth defining a flat tip 50 can be positioned on the support between a second set of a plurality of the teeth defining a sharp tip 40 and a third set of a plurality of the teeth defining a sharp tip 40.

Figure 4:
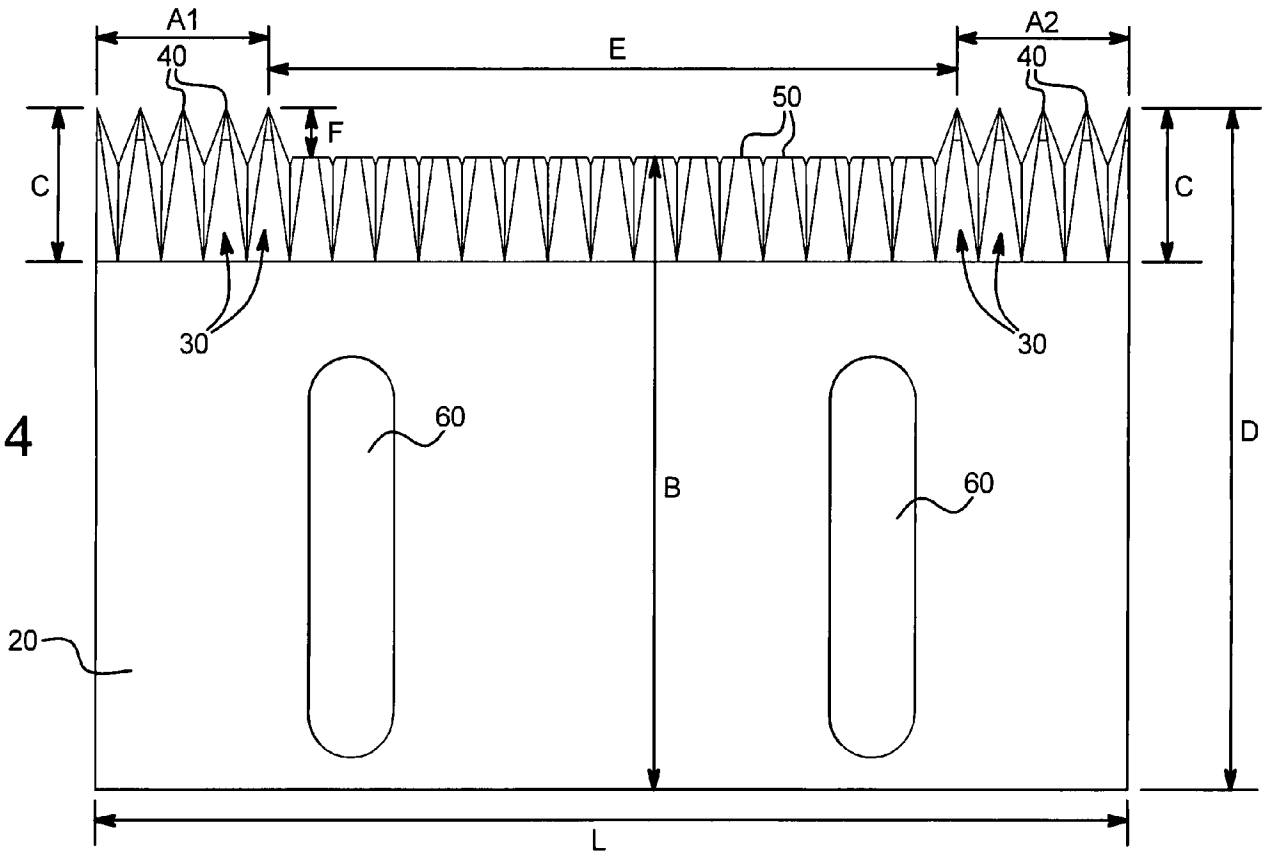
FIG. 4 illustrates a front elevation view of the blade in an embodiment of the present invention.

The teeth 30 defining a sharp tip 40 can be any suitable size and shape featuring a pointed or sharp edged configuration at the tip. The teeth 30 defining a flat tip 50 can be any suitable size or shape featuring a flat or blunt tip. The surface of the flat tip 50 can have any suitable area and any suitably shaped perimeter. The distance between the top of the teeth 30 defining a sharp tip 40 and the top of the teeth 30 defining a flat tip 50 (i.e. "F" as shown in FIG. 4) can be any suitable distance.

In an embodiment, the flat tip 50 of the teeth 30 defines a rough surface. For example, the flat tip can have a surface that is course or uneven (e.g. not smooth) when felt. In another embodiment, the flat tip 50 of the teeth 30 defines a smooth or even surface. Flat tip, as used herein, means that the tip can be flat or that the tip can have a rough or uneven surface. For example, the flat tip could be slightly concave or convex or could have a wavy shape. In one embodiment, when the flat tip portion of the blade is not even with the sharp tip portion of the blade, the flat has a surface with cutting edges that are the same or similar to those of the sharp tip.

The blade 10 can comprise a material such as a metal, a rigid plastic or combinations thereof. The blade 10 can comprise a single unitary piece (e.g. a single molded piece) or can comprise separate components such as teeth that are attached or sealed to the support.

In an embodiment, the support 20 defines one or more aperture 60. The apertures 60 can be any suitable shape and size, for example, that allows the blade 10 to be incorporated into any suitable device for holding the blade, e.g., a cutting or bag sealing assembly.

In an alternative embodiment, the first set comprises 15 teeth defining a flat tip 50. The second set and third set of teeth having a sharp tip 40 can each comprise 4½ teeth. For example, the blade can incorporate a design whereby four and one half (4½) outer teeth on both blade edges remain, and the center area of the cutting edge has the serrations (e.g. tips) removed. During tape cutting, it has surprisingly been found that this flat, non-cutting area of the blade can force the tape cut by the blade to "break" in a straight line and not leave any serrated edges to the tape seal. As a result, the edges of the tape that have been cut with a straight line have an improved strength over a cut tape having serrated edges. This improved strength results in less tearing of the tape when the tape has been attached to and used to seal off a package or container.

In yet another embodiment, the dimensions of the blade can be specified as illustrated in FIG. 4. For example, a length A1 of the second set of teeth added to a length A2 of the third set of teeth having a sharp tip can comprise a combined length that ranges from about 15% to about 40% of the length of the support L. In other words, the length A1 of the second set of teeth and the length A2 third set of teeth having a sharp tip are considered together in comparison to the overall length L of the support 20. In another embodiment, the length A1 of the second set of teeth 40 and length A2 of the third set of teeth 40 comprises a combined length that is about 20% of the length L of the support 20.

In still another embodiment, a difference in height F between the first set of teeth and the second set of teeth ranges from about 5% to about 22.8% of a height D of the blade 10. In another embodiment, the difference in height F between the first set of teeth and the second set of teeth is about 7.4% of the height D of the blade 10. The height C of the first set of teeth and the second set of teeth can be about 22.8% of the height D of the blade.

The blade can have any suitable length, height and thickness so as to fit in any device suitable for holding the blade, e.g., a cutting or bag sealing assembly. In an embodiment, the blade comprises a length of about 2.5 inches. In another embodiment, the blade comprises a height of about 1.6 inches. In yet another embodiment, the blade comprises a thickness of about 0.065 inches.

In another embodiment, the present invention provides a blade comprising a support, a first set of teeth comprising a flat tip attached to the support, a second set of at least four teeth comprising a sharp tip attached to the support, and a third set of at least four teeth comprising a sharp tip attached to the support. The first set of teeth is positioned between the second set teeth and the third set of teeth.

In an alternative embodiment, the present invention provides an assembly comprising a taping applicator comprising a blade holder and a blade attached to the blade holder of the taping applicator. The blade comprises a support and a plurality of teeth attached to the support. One or more of the plurality of teeth defines a sharp tip, and one or more of the plurality of teeth defines a flat tip.

The taping applicator can be any suitable taping applicator known by the skilled artisan that is compatible with the blade of the present invention. Representative non-limiting examples of the taping applicator are the Model PTA/T-627-2 Protective Tape Applicator, the Model T-626 Heavy-duty Flat Surface Tape Applicator, the Model T-627 Flat Surface Tape Applicator, the Model RSA-1 Round Surface Tape Applicator and the Model SD-625 Pressure Sensitive Tape Pad Applicator by Straub Design Company.

In another aspect, the present invention provides an assembly comprising a bag sealing machine comprising a blade holder incorporated into the bag sealing machine and a blade attached to the blade holder of the bag sealing machine. The blade comprises a support and a plurality of teeth attached to the support. One or more of the plurality of teeth defines a sharp tip, and one or more of the plurality of teeth defines a flat tip. In one embodiment, the bag sealing machine is a TFT machine. In one embodiment, the bag sealing machine contains an assembly comprising a taping applicator that comprises the blade. In a preferred embodiment, the assembly is a TFT machine containing a taping applicator comprising the blade.

The bag sealing machine and TFT machine can be any suitable machine known by the skilled artisan that is compatible with the blade of the present invention. For example, the TFT machine can trim, fold, and tape shut packages, bags, or other containers to provide a sturdy, roughed seal on the packaging material. A representative non-limiting example of a TFT machine is the TFT bag sealer manufactured by Doboy, Inc, well known in the art.

In still another embodiment, the present invention provides a method for cutting a material. The method comprises providing a blade comprising a support and a plurality of teeth attached to the support, wherein at least one of the plurality of teeth defines a sharp tip and at least one of the plurality of teeth defines a flat tip. The method further comprises cutting the material with the blade.

The blade can be incorporated as part of a taping applicator. Alternatively, the blade can be incorporated as part of a TFT bag sealing machine or a taping application in a TFT bag sealing machine.

The material can comprise any suitable tape or labels. For example, the material can comprise a polypropylene tape.

In an alternative embodiment, the present invention provides a method for sealing a container such as a bag or a package. The method comprises providing a blade comprising a support and a plurality of teeth attached to the support. At least one of the plurality of teeth defines a sharp tip and at least one of the plurality of teeth defines a flat tip. The blade is incorporated into a blade holder of a bag sealing machine, including a TFT machine or a taping applicator in a TFT machine.

A bag is placed in the bag sealing machine, including a TFT bag machine. A tape is attached to a portion of the bag to seal off the bag. For example, the tape can be attached to a folded opening portion of the bag. Any suitable tape for sealing the bag can be used.

Finally, the tape can be cut with the blade. For instance, the tape can be part of a roll, and the blade cuts the tape from the roll. The blade can also be used to cut off any loose ends of the tape extending from the bag.

EXAMPLES

By way of example and not limitation, the following examples are illustrative of various embodiments of the invention.

The development of the blade design of the present invention was a result of testing using standard knives including straight cut, perforated cut, guillotine cut, spear cut and finally an embodiment of the blade design of the present invention. Testing with the straight cut knife either did not cut the tape or cut it consistently. This led to jamming of the tape head and inconsistent placement on the package. The perforated knife cut and placed the tape consistently on the package, but the perforations left in the tape end led to premature opening of the package by allowing the tape to propagate (tear). Further testing using the guillotine and spear cut knife led to the same results achieved by using the straight cut knife, e.g., inconsistent tape placement and ragged cutting including machine jamming. This testing led to the development and design of the blade of the present invention that overcame all these issues as well as guaranteed accurate tape placement and stopped tape propagation (tearing). Basically, only the inventive blade cuts the tape in a manner that prevents tearing and premature bag opening (and spillage of the product in the bag).

Example 1

A blade was made from a piece of steel blade stock having the following dimensions: 2.50" wide×1.62" high×0.0650"

thick. The blade had 23 full teeth centered and 2 half teeth (one on each edge) across the 2.50" side. The center 15 teeth were milled to provide a flat area, for example, by removing 0.12" of material reducing the width to 1.50". The remaining 8 full teeth and two half teeth were equally divided to have 4 full teeth and one half tooth per side of the blade. The blade was used as the cutting blade in a bag sealing machine. Bags of dog food were made and tested for integrity by handling the bags in a manner consistent with transportation, storage, retail, and home use conditions for such products. None of the bags tested experienced a premature tear in the tape used to seal the bag. Similar tests were performed on bags made using standard knives, i.e., a straight cut, perforated cut, guillotine cut, spear cut blade. Tape applied using standard knives or blades did not provide a reliable seal strong enough to prevent tearing and opening of the bag at the seal fold area due to propagation. The results show that the blade of the present invention cuts tape in a manner that essentially prevents tape tearing the bags, particularly due to propagation tears.

Example 2

The blades in embodiments of the present invention were used for cutting a 2" wide polypropylene tape as part of a tape cutting assembly (e.g., a bag sealing machine). The blade design as described allows for tape tracking variability of ¼" in either direction, whereby at any time during the tape cutting process at least one of the 4½ teeth on both sides will contact the tape and initiate the cut and break. Several pieces of tape were cut and applied to bags for packaging dog food. The bags were filled with dog food and tested for seal integrity. The tape applied and cut with the present inventive blade did not tear when the bags were handled in simulated industrial conditions.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A blade comprising:

a support;

a first set of teeth attached to the support, each defining a flat tip, each flat tip comprising a top surface having a perimeter formed by a first side and a second side that are parallel to each other, a third side and a fourth side that are parallel to each other and perpendicular to the first side and the second side, and a fifth side and a sixth side that are not parallel to each other and not parallel to any of the first, second, third and fourth sides, each of the first set of teeth comprising:

a first lateral surface comprising a horizontal edge which is the fifth side of the top surface, the first lateral surface extends down from the fifth side of the top surface and shares a vertical edge with an adjacent tooth, the first lateral surface meets the support at one end of the vertical edge shared by the first lateral surface and the adjacent tooth, and the opposite end of the vertical edge shared by the first lateral surface and the adjacent tooth is adjacent to the top surface, and a second lateral surface comprising a horizontal edge which is the sixth side of the top surface, the second lateral surface extends down from the sixth side of the top surface and shares a vertical edge with another adjacent tooth, wherein the second lateral surface meets the support at one end of the vertical edge shared by the second lateral surface and the another adjacent tooth, and the opposite end of the vertical edge shared by the second lateral surface and the another adjacent tooth is adjacent to the top surface; and second and third sets of teeth attached to the support, each defining a sharp tip, and the first set of teeth is positioned on the support between the second and third sets of teeth.

2. The blade of claim 1 wherein the first set comprises 15 teeth defining a flat tip.

3. The blade of claim 1 wherein the second set and third set each comprises 4½ teeth defining a sharp tip.

4. The blade of claim 1 wherein the second set of teeth and the third set of teeth comprise a combined length that ranges from about 15% to about 40% of the length of the support.

5. The blade of claim 1 wherein the second set of teeth and the third set of teeth comprise a combined length that is about 20% of the length of the support.

6. The blade of claim 1 wherein a difference in height between the first set of teeth and the second set of teeth ranges from about 5% to about 25% of a height of the blade.

7. The blade of claim 1 wherein a difference in height between the first set of teeth and the second set of teeth is about 7% of a height of the blade.

8. The blade of claim 1 wherein a height of the first set of teeth and the second set of teeth is about 25% of a height of the blade.

9. The blade of claim 1 wherein the flat tip of the first set of teeth defines a rough surface that is the top surface of the flat tip.

10. The blade of claim 1 wherein the support defines at least one aperture.

11. The blade of claim 1 comprising a material selected from the group consisting of metal, rigid plastic, and combinations thereof.

12. The blade of claim 1 wherein each of the first set of teeth comprises:

a front surface extending from the support up to the first side of the top surface, the front surface comprising a horizontal edge formed by the first side of the top surface, the width of the front surface continuously increases as the front surface extends from the top surface toward the support, a third lateral surface extending from the support up to the third side of the top surface, the third lateral surface is a triangular surface having a perimeter formed by the third side of the top surface, a side of the front surface, and a side of the first lateral surface, the third lateral surface having a width that continuously decreases as the third lateral surface extends from the top surface toward the support, the third lateral surface only contacts the support at a vertex of the third lateral surface, a fourth lateral surface extending from the support up to the fourth side of the top surface, the fourth lateral surface is a triangular surface having a perimeter formed by the fourth side of the top surface, a side of the front surface, and a side of the second lateral surface, the fourth lateral surface having a width that continuously decreases as the fourth lateral surface extends from the top surface toward the support, the fourth lateral surface only contacts the support at a vertex of the fourth lateral surface, wherein the first lateral surface is a quadrilateral surface that only contacts the support at a corner of the first lateral surface, and the second lateral surface is a quadrilateral surface that only contacts the support at a corner of the second lateral surface.

13. An assembly comprising:

a bag sealing machine;

a blade holder incorporated into the bag sealing machine; and a blade attached to the blade holder, the blade comprising:

a support;

a first set of teeth attached to the support, each defining a flat tip, each flat tip comprising a top surface having a perimeter formed by a first side and a second side parallel to each other, a third side and a fourth side parallel to each other and perpendicular to the first side and the second side, and a fifth side and a sixth side that are not parallel to each other and not parallel to any of the first, second, third and fourth sides, each of the first set of teeth comprising:

a first lateral surface comprising a horizontal edge which is the fifth side of the top surface, the first lateral surface extends down from the fifth side of the top surface and shares a vertical edge with an adjacent tooth, the first lateral surface meets the support at one end of the vertical edge shared by the first lateral surface and the adjacent tooth, and the opposite end of the vertical edge shared by the first lateral surface and the adjacent tooth is adjacent to the top surface, and a second lateral surface comprising a horizontal edge which is the sixth side of the top surface, the second lateral surface extends down from the sixth side of the top surface and shares a vertical edge with another adjacent tooth, the second lateral surface meets the support at one end of the vertical edge shared by the second lateral surface and the another adjacent tooth, and the opposite end of the vertical edge shared by the second lateral surface and the another adjacent tooth is adjacent to the top surface; and second and third sets of teeth attached to the support, each defining a sharp tip; the first set of teeth positioned on the support between the second and third sets of teeth.

14. The assembly of claim 13 wherein the bag sealing machine is a TFT machine.

15. The assembly of claim 14 wherein the blade holder is a taping applicator.

16. The assembly of claim 13 wherein the blade holder is a taping applicator.

17. A method for cutting a material comprising:

cutting the material with a blade in a taping applicator that comprises a blade holder to which the blade is attached, the blade comprising:

a support;

a first set of teeth attached to the support, each defining a flat tip, each flat tip comprising a top surface having a perimeter formed by a first side and a second side parallel to each other, a third side and a fourth side parallel to each other and perpendicular to the first side and the second side, and a fifth side and a sixth side that are not parallel to each other and not parallel to any of the first, second, third and fourth sides, each of the first set of teeth comprising:

a first lateral surface comprising a horizontal edge which is the fifth side of the top surface, the first lateral surface extends down from the fifth side of the top surface and shares a vertical edge with an adjacent tooth, the first lateral surface meets the support at one end of the vertical edge shared by the first lateral surface and the adjacent tooth, and the opposite end of the vertical edge shared by the first lateral surface and the adjacent tooth is adjacent to the top surface, and a second lateral surface comprising a horizontal edge which is the sixth side of the top surface, the second lateral surface extends down from the sixth side of the top surface and shares a vertical edge with another adjacent tooth, the second lateral surface meets the support at one end of the vertical edge shared by the second lateral surface and the another adjacent tooth, and the opposite end of the vertical edge shared by the second lateral surface and the another adjacent tooth is adjacent to the top surface; and second and third sets of teeth attached to the support, each defining a sharp tip; the first set of teeth positioned on the support between the second and third sets of teeth.

18. The method of claim 17 wherein the material is selected from the group consisting of a tape, a label, and combinations thereof.

19. The method of claim 17 wherein the material comprises a polypropylene tape.

20. The method of claim 17 wherein the assembly is a TFT bag sealing machine.

* * * * *